US010583447B2

(12) United States Patent
Ghosh

(10) Patent No.: US 10,583,447 B2
(45) Date of Patent: Mar. 10, 2020

(54) DIFFUSER ARM (DA) FOR IMPACT SPRINKLERS

(71) Applicant: Automat Irrigation Pvt. Ltd., Delhi (IN)

(72) Inventor: Durga Pada Ghosh, Gaziabad (IN)

(73) Assignee: Automat Irrigation Pvt. Ltd., Delhi (IN)

( * ) Notice: Subject to any disclaimer, the term of this patent is extended or adjusted under 35 U.S.C. 154(b) by 49 days.

(21) Appl. No.: 16/069,741

(22) PCT Filed: Jan. 13, 2017

(86) PCT No.: PCT/IN2017/000010
§ 371 (c)(1),
(2) Date: Jul. 12, 2018

(87) PCT Pub. No.: WO2017/122221
PCT Pub. Date: Jul. 20, 2017

(65) Prior Publication Data

US 2019/0015851 A1 Jan. 17, 2019

(30) Foreign Application Priority Data

Jan. 14, 2016 (IN) ..... 201611001352

(51) Int. Cl.
*B05B 3/04* (2006.01)
*B05B 3/08* (2006.01)

(52) U.S. Cl.
CPC ..... *B05B 3/0481* (2013.01); *B05B 3/0472* (2013.01); *B05B 3/08* (2013.01); *B05B 3/0477* (2013.01)

(58) Field of Classification Search
CPC ..... B05B 3/08; B05B 3/0481; B05B 3/0472; B05B 3/0477
USPC ..... 239/225.1, 230, 231, 232, 233, 511
See application file for complete search history.

(56) References Cited

U.S. PATENT DOCUMENTS 2,816,798 A 7/1954 Royer
4,205,788 A 6/1980 Bruninga
5,031,835 A 7/1991 Rojas
(Continued)

FOREIGN PATENT DOCUMENTS

JP S63 98745 U 6/1988

OTHER PUBLICATIONS

International Preliminary Report on Patentability dated Jul. 17, 2018, in counterpart International (PCT) Application No. PCT/IN2017/000010.
(Continued)

*Primary Examiner* — Steven J Ganey
(74) *Attorney, Agent, or Firm* — Womble Bond Dickinson (US) LLP

(57) ABSTRACT

An irrigation sprinkler has a vertical axis (A) and is configured to emit a liquid jet. The sprinkler includes a base and a head operatively connected to the. A reciprocal element rotatably mounted to the head is configured to undergo reciprocal motion about the vertical axis (A), in response to being impacted with the liquid jet from a nozzle belonging to the head. The reciprocal element has a diffuser arm which carries a plurality of integrally formed, spaced apart diffuser posts which are configured to be hit by, and diffuse the liquid jet during the reciprocal motion.

20 Claims, 6 Drawing Sheets

(56) References Cited

U.S. PATENT DOCUMENTS

| | | | | |
|---|---|---|---|---|
| 5,209,404 | A * | 5/1993 | Jun | B05B 3/0477 239/230 |
| 5,370,311 | A * | 12/1994 | Chen | B05B 3/063 239/230 |
| 7,014,125 | B2 * | 3/2006 | Lerner | B05B 3/021 239/225.1 |
| 7,841,545 | B2 * | 11/2010 | Wang | B05B 15/652 239/230 |
| 2011/0132997 | A1 | 6/2011 | Gal et al. | |

OTHER PUBLICATIONS

International Search Report dated Jun. 19, 2017, in counterpart International (PCT) Application No. PCT/IN2017/000010.
Written Opinion dated Jun. 19, 2017, in counterpart International (PCT) Application No. PCT/IN2017/000010.

* cited by examiner

DIFFUSER ARM (DA) FOR IMPACT SPRINKLERS

RELATED APPLICATIONS

This is a 35 USC 371 U.S. National Phase of International Application No. PCT/IN2017/000010 filed 13 Jan. 2017 and published in English as WO 2017/122221A1 on 20 Jul. 2017, which claims priority to Indian Application No. 201611001352, filed 14 Jan. 2016. The contents of the aforementioned applications are incorporated by reference in their entirety.

TECHNICAL FIELD

Embodiments of the invention relate to irrigation sprinklers and in particular to sprinklers having an improved water distribution.

BACKGROUND

Irrigation sprinklers are normally required to have a relative uniform distribution of water around an area covered by the sprinkler. Various arrangements exist for addressing this need, including sprinklers with deflection surfaces for downward deflection of water emitted by the sprinkler to areas closer to the sprinkler.

U.S. Pat. No. 4,000,853 for example describes a sprinkler having an oscillating arm with a deflector disposed so as to intercept the sprinklers water jet in order to deflect water also downwardly. U.S. Pat. No. 8,672,236 in a further example describes a sprinkler having a reciprocal element with differently angled deflective surfaces for deflecting a jet emitted from the sprinkler in a downward direction to yield different irrigation ranges.

Other arrangements may be proposed for obtaining such uniform distribution of sprinkled water, however, with a simpler construction.

SUMMARY

The following embodiments and aspects thereof are described and illustrated in conjunction with systems, toots and methods which are meant to be exemplary and illustrative, not limiting in scope.

In one aspect, the invention is directed to an irrigation sprinkler having a vertical axis (A) and configured to emit a liquid jet. The inventive sprinkler comprises:

a base adapted for connection to a liquid source;

a head operatively connected to the base and configured to rotate in a rotation direction about the vertical axis (A), the head having a nozzle configured to emit a liquid jet;

a reciprocal element rotatably mounted to the head for reciprocal motion thou vertical axis (A), in response to being impacted with the liquid jet from the nozzle, wherein the reciprocal element comprises a diffuser arm connected at a fixed end thereof, and extending in a direction perpendicular to the vertical axis (A) to a free end thereof, the diffuser arm comprising a plurality of integrally formed, spaced apart diffuser posts located proximate the free end, each diffuser post configured to be hit by, and diffuse the liquid jet during the reciprocal motion.

BRIEF DESCRIPTION OF THE FIGURES

Exemplary embodiments are illustrated in referenced figures. It is intended that the embodiments and figures disclosed herein are to be considered illustrative, rather than restrictive. The invention, however, both as to organization and method of operation, together with objects, features, and advantages thereof, may best be understood by reference to the following detailed description when read with the accompanying figures, in which.

Figure 1A:
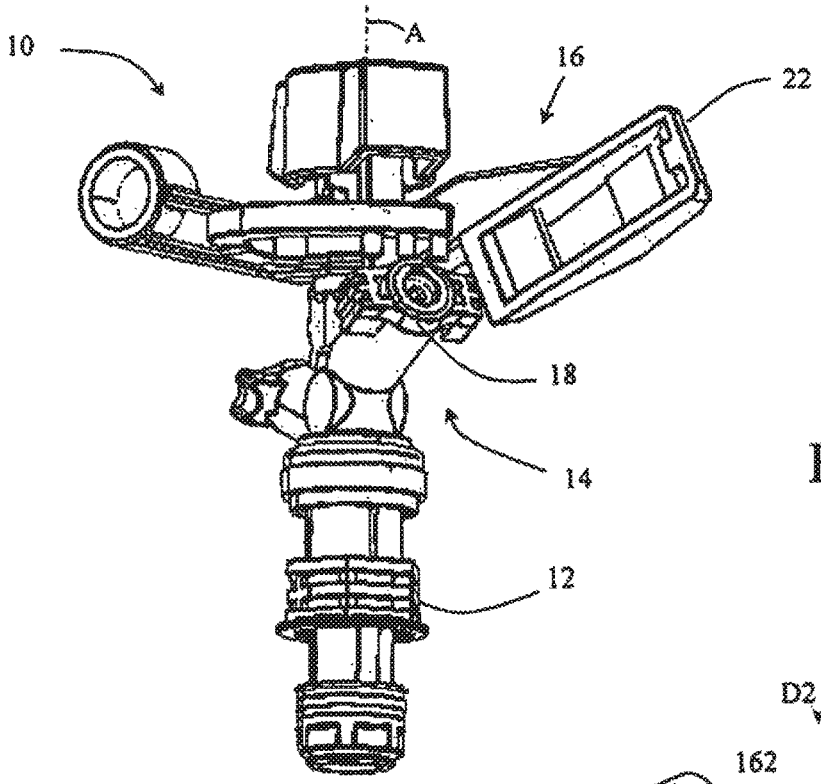
FIGS. 1A to 1C schematically show, respectively, perspective bottom and top views of a sprinkler in accordance with an embodiment of the invention and an embodiment of head of the sprinkler.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated within the figures to indicate like elements.

DETAILED DESCRIPTION

The aforementioned U.S. Pat. Nos. 4,000,853 and 8,672,236 are incorporated by reference to the extent necessary to understand the subject matter of the present application.

Figure 1B:
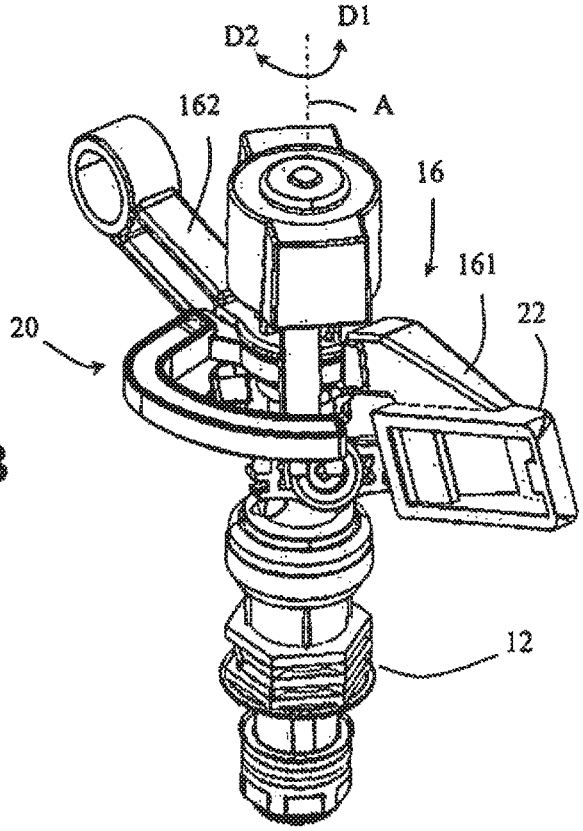
Figure 1C:
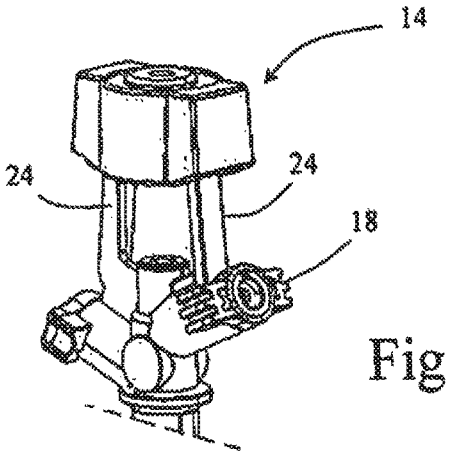

Attention is first drawn to FIGS. 1A to 1C illustrating a sprinkler 10 according to an embodiment of the invention having a vertical axis of rotation A. Sprinkler 10 is configured to perform a rotational movement about axis A for distributing irrigation liquid to the surrounding environment around the sprinkler. Liquid emitted by the sprinkler may include water often containing plant nutrients, pesticides and/or medications, (and the like) for plants.

Sprinkler 10 includes a base 12, a head 14 and a reciprocal element 16. Base 12 may be connectable at its lower end to a liquid supply (not shown). Head 14 is rotatable supported in the sprinkler by, e.g., friction engagement with a portion of the sprinkler in order to damp or limit its rotation. Possibly, such rotatable engagement is with base 12. Head 14 includes at least one nozzle 18 for emitting a liquid jet from the sprinkler to the outside environment.

Reciprocal element 16 is supported at a vicinity of its center for rotation about axis A and includes two segments 161, 162 located on opposite sides of axis A. The reciprocal element 16 may be supported for rotation by the base 12. Reciprocal element 16 includes a lever 22 on the first segment 161. Reciprocal element 16 also includes a diffuser arm 20 extending out from the second segment 162 or from a portion of element 16 adjacent axis A.

Lever 22 is adapted to be impinged by a liquid jet emitted by nozzle 18, which in turn urges element 16 to perform a reciprocal motion about axis A. This reciprocal motion starts with a rotation of element 16 in a first (possibly counter-clockwise in a top view) rotational direction D1 about axis A, which winds a sprinkler spring (not shown). After a certain rotation in direction D1, the sprinkler spring unwinds, urging element 16 to rotate back in a counter rotational direction D2 about axis A.

This rotation in direction D2 is configured at a certain point to end the reciprocal motion of element 16 about axis A by urging element 16 to impact against an abutment stop on head 14. The impact against head 14 is configured to slightly rotate head 14 in direction D2 and by that slightly change the angular direction of nozzle 18 about axis A. Each subsequent reciprocal motion of element 16 about axis A, which starts with lever 22 being impinged again by the liquid jet emitted from nozzle 18, is adapted to end with an additional, slight stepped rotation of nozzle 18 in direction D2 about axis A.

With attention drawn to FIG. 1C one embodiment of a head 14 of the sprinkler is shown including two posts 24 configured to extend in the vertical direction, alongside and on opposing sides of axis A when the head 14 is assembled in the sprinkler. The impact of element 16 at the end of each reciprocal motion may be against at least one of the posts 24, which serves as the aforementioned abutment stop.

Figure 2:
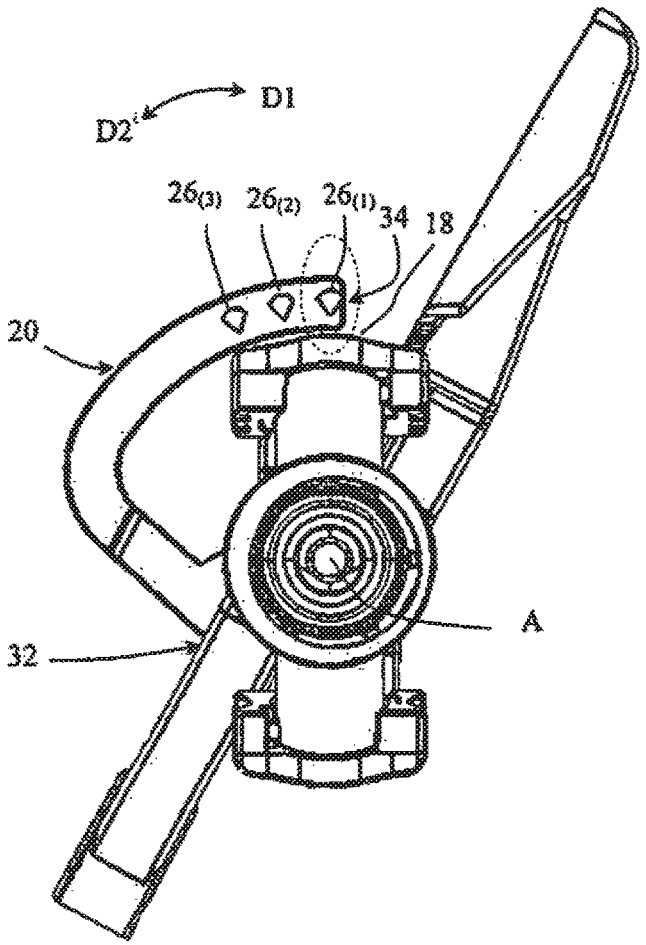
FIG. 2 schematically shows a bottom view of a sprinkler possibly similar to that in FIG. 1, revealing diffuser posts according to an embodiment of the invention for diffusing liquid emitted from the sprinkler.

As seen in FIGS. 1A, 1B, diffuser arm 20 extends in a generally horizontal direction, perpendicular to the vertical sprinkler axis A. Attention is now drawn to FIG. 2 showing a bottom side of the sprinkler 10. Diffuser arm 20 is generally sickle shaped and extends in the horizontal plane, along a curved path in direction D1 from proximate its fixed end 32 where it is connected to the reciprocating element 16, up to a free end 34. A bottom side of arm 20 is provided with a plurality of integrally formed, spaced apart diffuser posts 26. In the figures shown, three such diffuser posts, labeled 26-1, 26-2, 26-3 are shown, though other number of posts may be provided. In the embodiment shown, the diffuser posts 26 project downwardly from the diffuser arm 20 in a direction generally parallel to the vertical axis (A). Also, the diffuser posts are identical to one another and evenly spaced apart from one another at different distances from the free end 34 of the diffuser arm 20.

In a preferred embodiment, the diffuser posts are wedged-shaped with a narrow end 36 of the wedge facing the nozzle. Each post 26 is symmetric about a bisector line B passing through the narrow end 36 so that the liquid jet from the nozzle can be evenly dispersed to either side of the post, as the post is carried by the diffuser arm 20, past the nozzle 18. In further preferred embodiments (not shown) the diffuser posts hay have other profiles. For example, instead of a wedged-shaped profile each diffuser post may have a circular profile in a cross section taken in an imaginary plane perpendicular to the vertical sprinkler axis A.

Figure 3C:
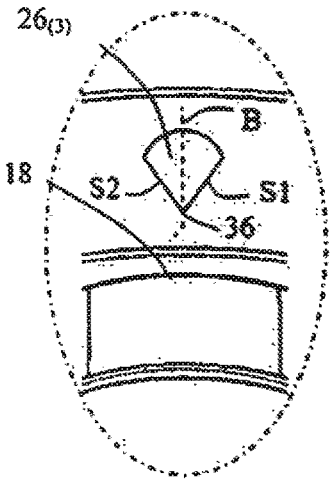
FIGS. 3A to 3C schematically show, each, a respective one of the diffuser posts in FIG. 2 positioned in front of a nozzle of the sprinkler.
Figure 3B:
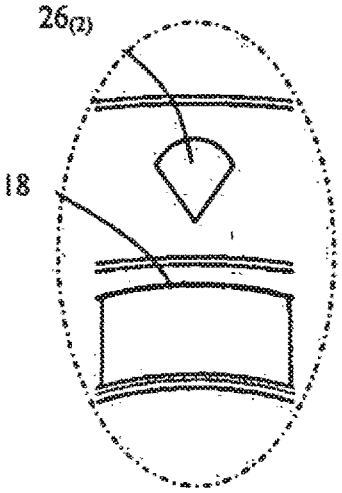
Figure 3A:
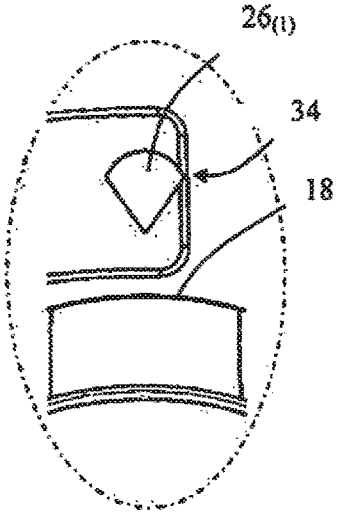

In FIGS. 3A to 3C three 'operative' positions of diffuser arm 20 during a reciprocal motion of reciprocal element 16 are seen. In FIG. 3A, a first 'operative' position is illustrated in which first diffuser post $\mathbf{26}_{(1)}$ located nearest the free end 34 of diffuser arm 20 is located in front of nozzle 18. In FIG. 3B, a second 'operative' position is illustrated in which a second diffuser post $\mathbf{26}_{(2)}$ spaced apart from first diffuser post $\mathbf{26}_{(1)}$ in direction D2 is seen located in front of nozzle 18. In FIG. 3C, a third 'operative' position is illustrated in which a third diffuser post $\mathbf{26}_{(3)}$ spaced apart from second post $\mathbf{26}_{(2)}$ and furthest to the free end 34 is seen located in front of nozzle 18.

Figure 4A:
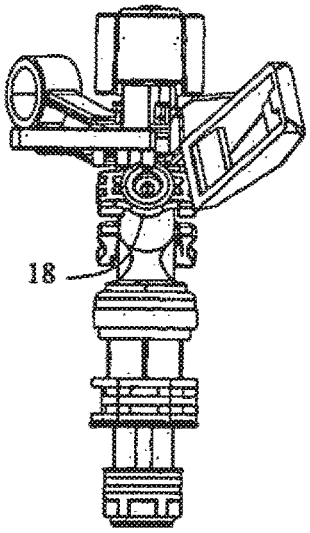
FIGS. 4A to 4C schematically show the sprinkler in different reciprocal states in which different diffuser posts are in front of the sprinkler's nozzle.
Figure 4B:
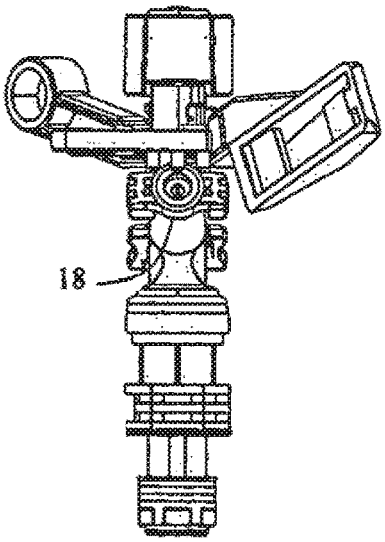
Figure 4C:
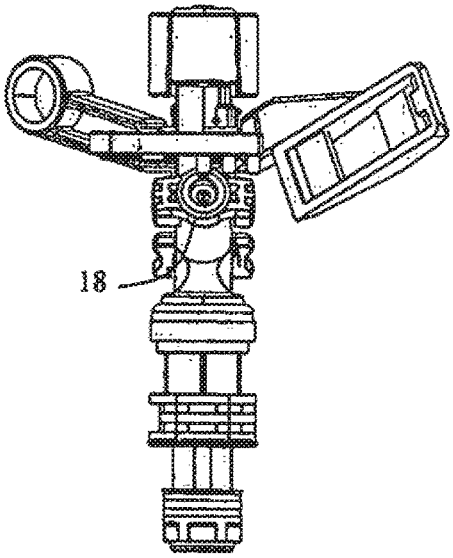

With attention drawn to FIGS. 4A to 4C, similar respective 'operative' positions to those seen in FIG. 3 are illustrated, of diffuser arm 20 during a reciprocal motion of element 16. In the side view provided in these figures, sprinkler 10 in each such 'operative' position is seen with a different diffuser post 26 placed in front of its nozzle 18. The posts 26 are situated on diffuser arm 20 such that they present identical profiles to the nozzle 18, as they pass by, during entry and return portions of the reciprocating motion of element 16.

Figure 5A:
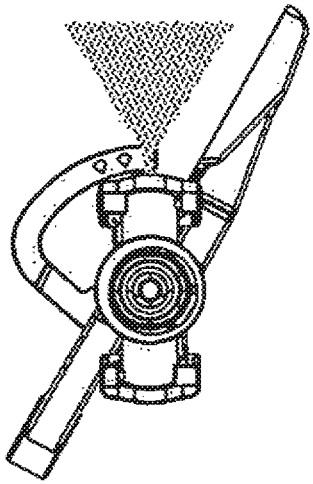
FIGS. 5A to 5C schematically show a bottom view of the sprinkler, illustrating an exemplary dispersion pattern when the liquid jet from the nozzle, strikes the different diffuser posts.
Figure 5B:
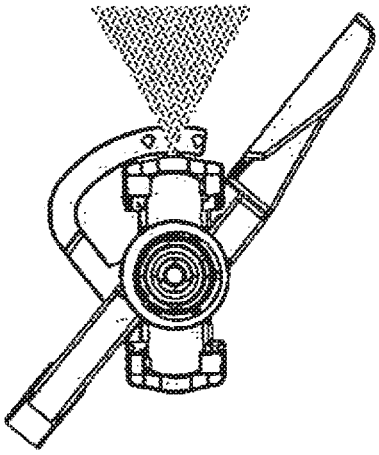
Figure 5C:
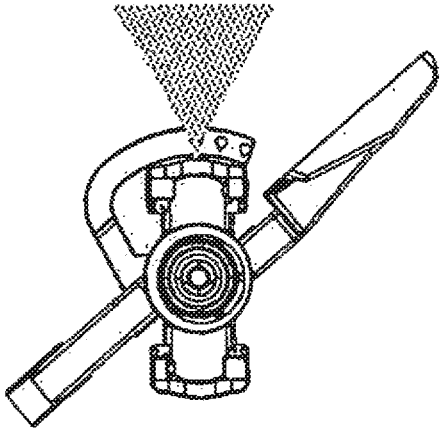

With attention drawn to FIG. 5A to 5C, similar respective 'operative' positions to those seen in FIGS. 3 and 4 are illustrated, of diffuser arm 20 during a reciprocal motion of element 16. These figures show a bottom view of the sprinkler. In these 'operative' positions an identical diffusing effect occurs as a liquid jet emitted by nozzle 18 meets a respective diffuser post 26. This is illustrated by the similar shaped dotted shapes seen spreading laterally sideways.

Figure 6A:
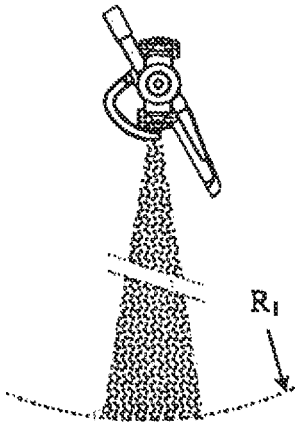
FIGS. 6A to 6C schematically show a top view of the sprinkler, illustrating an exemplary distribution range when the liquid jet from the nozzle strikes the different diffuser posts.
Figure 6B:
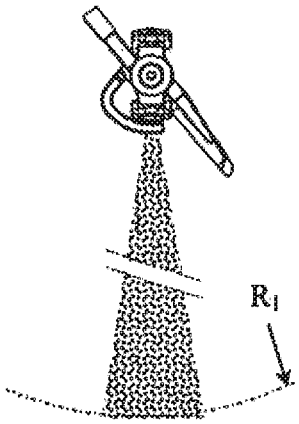
Figure 6C:
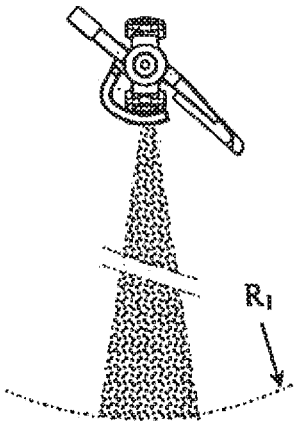

With attention drawn to FIG. 6A to 6C, similar respective 'operative' positions to those seen in FIGS. 3 to 5 are illustrated, of diffuser arm 20 during a reciprocal motion of element 16. These figures show a top view of the sprinkler. In these 'operative' positions a radial range $R_1$ away from axis A of a diffused liquid jet is seen being generally similar in all 'operative' positions.

Liquid from the nozzle 18 is spread in the same pattern and range, regardless of which post 26 the liquid strikes, as the arm moves past the nozzle 18. In the example of the wedge-shaped posts, as each post 26 passes by the nozzle 18 in e.g. a return portion of a reciprocal motion, the liquid jet from the nozzle 18 first hits the post's first angled surface S1 and is deflected sideways in a first direction, then hits the post's narrow end 36 and is split so that liquid is deflected sideways by both angled surfaces to either side of the bisector line B, and lastly hits the post's second angled surface S2 to be deflected sideways in a second direction, more or less "mirror symmetric" to the first direction about line B. Since the optional wedge-shaped posts are symmetric about the bisector line B as they pass the nozzle, the dispersal range is roughly the same, regardless of which portion of the post is being hit by the liquid jet.

Figure 7A:
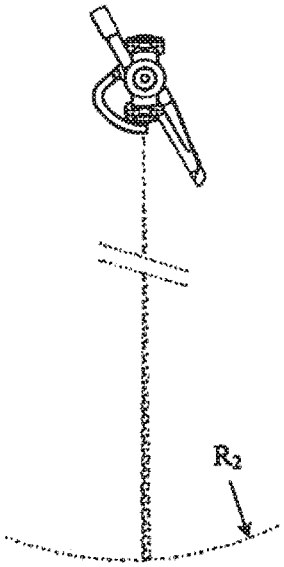
FIGS. 7A to 7C schematically show a top view of the sprinkler, illustrating an exemplary distribution range of emitted liquid just after cessation of engagement with each of the diffuser posts.
Figure 7B:
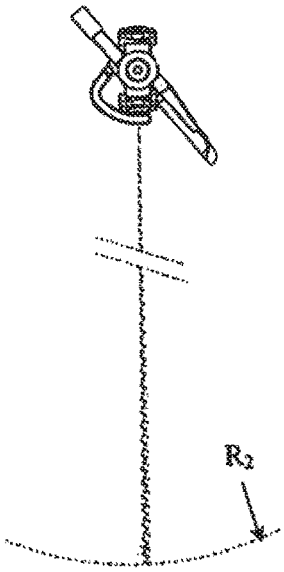
Figure 7C:
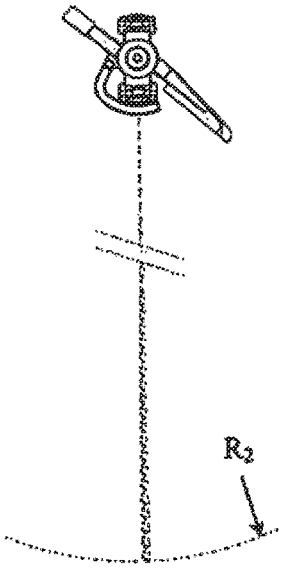

With attention drawn to FIG. 7A to 7C, 'non-operative' positions just after or before engagement of a liquid jet with a diffuser post 26 are seen. That is to say that such 'non-operative' positions represent cases where an ejected liquid jet from nozzle 18 passes substantially undisturbed in a space between adjacent diffuser posts 26 and/or at a location away from all the diffuser posts 26. These figures show a top view of the sprinkler. FIG. 7A corresponds to 'non-operative' position during a reciprocal motion of element 16 where a liquid jet emitted from nozzle 18 passes in a space between diffuser post $\mathbf{26}_{(1)}$ and $\mathbf{26}_{(2)}$. FIG. 7B corresponds to a 'non-operative' position during a reciprocal motion of element 16 where a liquid jet emitted from nozzle 18 passes in a space between diffuser posts $\mathbf{26}_{(3)}$ and $\mathbf{26}_{(2)}$. FIG. 7C corresponds to a 'non-operative' position during a reciprocal motion of element 16 where a liquid jet emitted from nozzle 18 passes at a location beyond diffuser post $\mathbf{26}_{(3)}$ distal to diffuser post $\mathbf{26}_{(2)}$.

As seen in these figures, a radial range $R_2$ away from axis A of a non-diffused liquid jet is generally similar in all non-operative positions, with the radial range $R_2$ being larger than range $R_1$ of a diffused liquid jet.

Combination of rotation of various embodiments of sprinkler 10 about axis A together with intermittent interference by diffusion with the ejected liquid jet—have been found to provide an evenly distributed spraying pattern suitable for irrigation purposes.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

Furthermore, while the present application or technology has been illustrated and described in detail in the drawings and foregoing description, such illustration and description are to be considered illustrative or exemplary and non-restrictive; the technology is thus not limited to the disclosed embodiments. Variations to the disclosed embodiments can be understood and effected by those skilled in the art and practicing the claimed technology, from a study of the drawings, the technology, and the appended claims.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage.

The present technology is also understood to encompass the exact terms, features, numerical values or ranges etc., if in here such terms, features, numerical values or ranges etc. are referred to in connection with terms such as "about, ca., substantially, generally, at least" etc. In other words, "about 3" shall also comprise "3" or "substantially perpendicular" shall also comprise "perpendicular". Any reference signs in the claims should not be considered as limiting the scope.

Although the present embodiments have been described to a certain degree of particularity, it should be understood that various alterations and modifications could be made without departing from the scope of the invention as hereinafter claimed.

I claim:

1. An irrigation sprinkler having a vertical axis (A) and configured to emit a liquid jet, the sprinkler comprising:

a base adapted for connection to a liquid source;

a head operatively connected to the base and configured to rotate in a rotation direction about the vertical axis (A), the head having a nozzle configured to emit a liquid jet;

a reciprocal element rotatably mounted to the head for reciprocal motion about the vertical axis (A), in response to being impacted with the liquid jet from the nozzle, wherein:

the reciprocal element comprises a diffuser arm connected at a fixed end thereof, and extending in a direction perpendicular to the vertical axis (A) to a free end thereof, the diffuser arm comprising a plurality of integrally formed, spaced apart diffuser posts, each diffuser post configured to be hit by, and diffuse the liquid jet during the reciprocal-motion;

liquid from the liquid jet reaches a first range R1, when the liquid jet hits any one of the plurality of diffuser posts; and liquid from the liquid jet reached a second range R2, which is greater than R1, when the liquid jet does not hit any one of the plurality of diffuser posts.

2. The irrigation sprinkler of claim 1, wherein:

the diffuser arm extends at least in part along a curve about the vertical axis (A); and the diffuser posts project downwardly from the diffuser arm, in a direction generally parallel to the vertical axis (A).

3. The irrigation sprinkler of claim 2, wherein:

the diffuser posts are identical to one another and evenly spaced apart from one another at different distances from the free end of the diffuser arm.

4. The irrigation sprinkler of claim 1, wherein:

the liquid jet emitted by the sprinkler head is configured to pass below the diffuser arm and intermittently hit and be dispersed by the plurality of diffuser posts, during the reciprocal motion.

5. The irrigation sprinkler of claim 1, wherein each diffuser post hit by the liquid jet is configured to deflect the liquid sideways.

6. The irrigation sprinkler of claim 1, wherein:

the range R1 is the same for all of the plurality of diffuser posts.

7. The irrigation sprinkler of claim 1, wherein:

each post is wedge-shaped, having a narrow end facing the nozzle and first and second angled surface which are symmetric about a bisector line passing through the narrow end.

8. The irrigation sprinkler of claim 7, wherein:

the diffuser arm travels past the nozzle during the reciprocating portion;

as each post passes by the nozzle, the liquid jet from the nozzle first hits the post's first angled surface and is deflected sideway in a first direction, then hits the narrow end of the post and is deflected sideways by both angled surfaces to either side of the bisector line, and lastly hits the post's second angled surface to be deflected sideways in a second direction which is mirror symmetric to the first direction; and the dispersal range is roughly the same, regardless of which portion of the post is being hit by the liquid jet.

9. The irrigation sprinkler of claim 1, wherein the diffuser posts are located proximate the free end of the diffuser arm.

10. A method of irrigating comprising:

providing an irrigation sprinkler having a vertical axis (A) and comprising a head and a reciprocal element, the head comprising a nozzle and being configured to rotate about the vertical axis (A); and the reciprocal element being rotatably mounted to the head for reciprocal motion about the vertical axis (A), wherein the reciprocal element comprises a diffuser arm extending generally about the vertical axis (A) and a plurality of spaced apart diffuser posts integrally formed with the arm, emitting a liquid jet from the nozzle of the sprinkler's head, wherein:

the emitted jet is configured to at least momentarily impact the reciprocal element in order to urge its reciprocal motion about the vertical axis (A), the emitted jet is also configured to at least momentarily hit and be diffused by each diffuser post during the reciprocal motion of the reciprocal element, liquid from the liquid jet reaches a first range R1, when the liquid jet hits any one of the plurality of diffuser posts; and liquid from the liquid jet reached a second range R2, which is greater than R1, when the liquid jet does not hit any one of the plurality of diffuser posts.

11. The method of claim 10, wherein:

the diffuser arm extends at least in part along a curve about the vertical axis (A); and the diffuser posts project downwardly from the diffuser arm, in a direction generally parallel to the vertical axis (A).

12. The method of claim 11, wherein:

the diffuser posts are identical to one another and evenly spaced apart from one another.

13. The method of claim 10, wherein:

the liquid jet emitted by the sprinkler head is configured to pass below the diffuser arm and intermittently hit and be dispersed by the plurality of diffuser posts, during the reciprocal motion.

14. An irrigation sprinkler having a vertical axis (A) and configured to emit a liquid jet, the sprinkler comprising:

a base adapted for connection to a liquid source;

a head operatively connected to the base and configured to rotate in a rotation direction about the vertical axis (A), the head having a nozzle configured to emit a liquid jet;

a reciprocal element rotatably mounted to the head for reciprocal motion about the vertical axis (A), in response to being impacted with the liquid jet from the nozzle, wherein:

the reciprocal element comprises a diffuser arm connected at a fixed end thereof, and extending in a direction perpendicular to the vertical axis (A) to a free end thereof, the diffuser arm comprising a plurality of integrally formed, spaced apart diffuser posts, each diffuser post configured to be hit by, and diffuse the liquid jet during the reciprocal-motion;

each post is wedge-shaped, having a narrow end facing the nozzle and first and second angled surface which are symmetric about a bisector line passing through the narrow end;

the diffuser arm travels past the nozzle during the reciprocating portion;

as each post passes by the nozzle, the liquid jet from the nozzle first hits the post's first angled surface and is deflected sideway in a first direction, then hits the narrow end of the post and is deflected sideways by both angled surfaces to either side of the bisector line, and lastly hits the post's second angled surface to be deflected sideways in a second direction which is mirror symmetric to the first direction; and the dispersal range is roughly the same, regardless of which portion of the post is being hit by the liquid jet.

15. The irrigation sprinkler of claim 14, wherein:

the diffuser arm extends at least in part along a curve about the vertical axis (A); and the diffuser posts project downwardly from the diffuser arm, in a direction generally parallel to the vertical axis (A).

16. The irrigation sprinkler of claim 15, wherein:

the diffuser posts are identical to one another and evenly spaced apart from one another at different distances from the free end of the diffuser arm.

17. The irrigation sprinkler of claim 14, wherein:

the liquid jet emitted by the sprinkler head is configured to pass below the diffuser arm and intermittently hit and be dispersed by the plurality of diffuser posts, during the reciprocal motion.

18. The irrigation sprinkler of claim 14, wherein each diffuser post hit by the liquid jet is configured to deflect the liquid sideways.

19. The irrigation sprinkler of claim 14, wherein:

liquid from the liquid jet reaches a first range R1, when the liquid jet hits any one of the plurality of diffuser posts; and liquid from the liquid jet reached a second range R2, which is greater than R1, when the liquid jet does not hit any one of the plurality of diffuser posts.

20. The irrigation sprinkler of claim 14, wherein the diffuser posts are located proximate the free end of the diffuser arm.

* * * * *